US006829870B2

(12) United States Patent
Hur

(10) Patent No.: US 6,829,870 B2
(45) Date of Patent: Dec. 14, 2004

(54) BUILDING METHODS

(75) Inventor: Teow Beng Hur, Selangor Darul Ehasn (MY)

(73) Assignee: HC Precast System SDN. BHD, Selangor Darul Ehasn (MY)

( * ) Notice: Subject to any disclaimer, the term of this patent is extended or adjusted under 35 U.S.C. 154(b) by 16 days.

(21) Appl. No.: 10/285,548

(22) Filed: Nov. 1, 2002

(65) Prior Publication Data

US 2004/0016199 A1 Jan. 29, 2004

(51) Int. Cl.[7] ..... E04C 2/38

(52) U.S. Cl. ..... 52/656.1; 52/563; 52/631; 249/47; 249/191

(58) Field of Search ..... 249/19, 22, 26, 249/27, 47, 191; 52/426, 562, 563, 275, 656.1, 631

(56) References Cited

U.S. PATENT DOCUMENTS 2,939,500 A * 6/1960 Grant ..... 269/102
3,288,427 A * 11/1966 Pluckebaum ..... 249/192
5,078,360 A * 1/1992 Spera ..... 249/26
5,102,092 A * 4/1992 Salas ..... 249/192
5,553,430 A * 9/1996 Majnaric et al. ..... 52/236.8
5,740,648 A * 4/1998 Piccone ..... 52/426

* cited by examiner

*Primary Examiner*—Korie Chan
(74) *Attorney, Agent, or Firm*—Nath & Associates PLLC; Harold L. Novick

(57) ABSTRACT

A building is erected using pre-cast wall panels, preferably load-bearing wall panels having a shear key on each vertical edge and starter bars on each horizontal edge, by first erecting the wall panels, and then casting a concrete column around the vertical edges of adjacent or intersecting wall panels using movable formwork made up from a set of standard modules that can be assembled to form different configurations and sizes of column for different panel arrangements. The moulding surfaces of the modules may be shaped to provide decorative features to the columns and/or the column/wall intersections.

3 Claims, 5 Drawing Sheets

BUILDING METHODS

Figure 1:
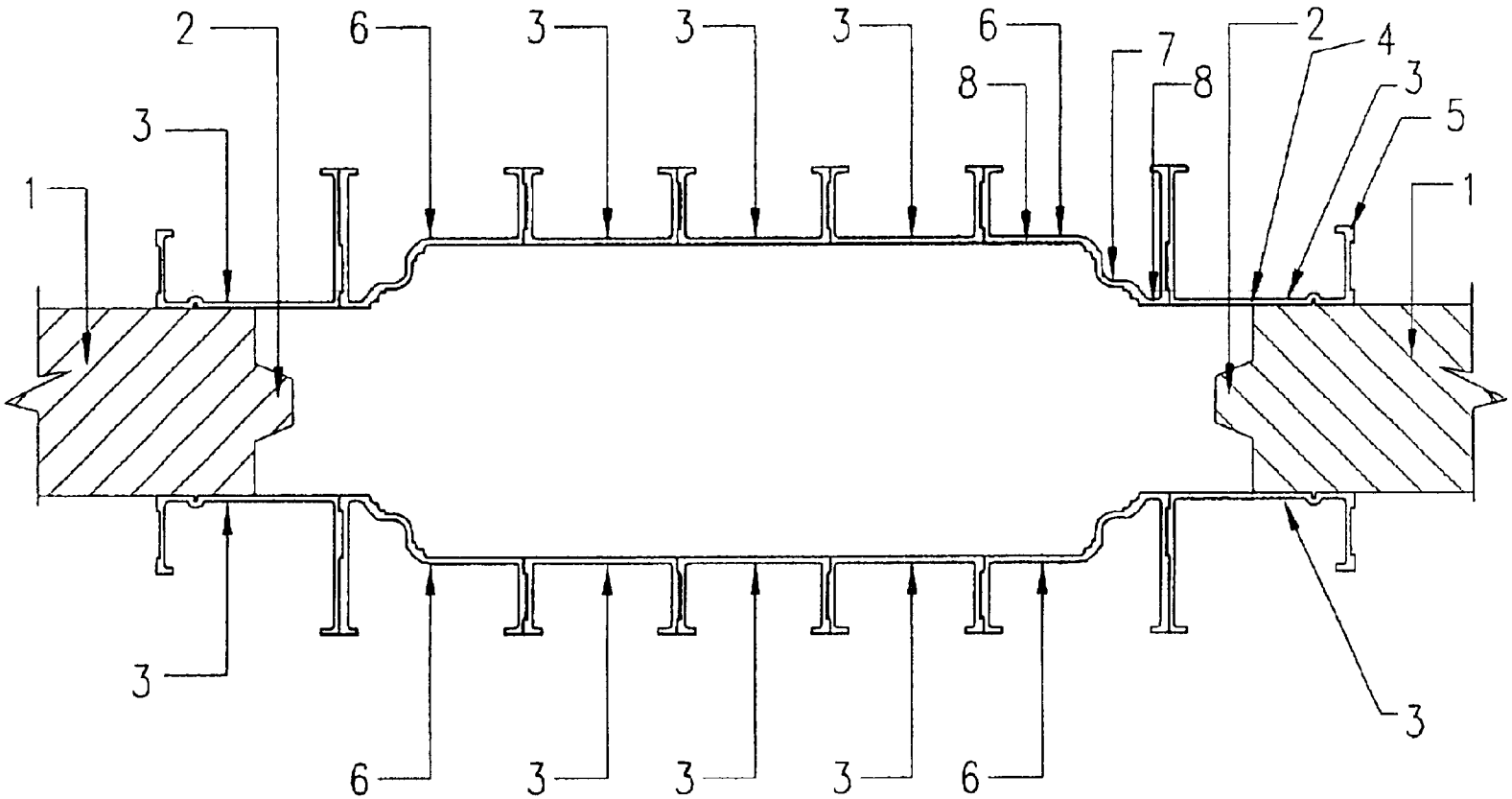

This invention relates to building methods and, more particularly, provides a new building method using prefabricated wall panels interconnected by cast-in-situ columns.

BACKGROUND TO THE INVENTION

The conventional methods of building with reinforced concrete and bricks and mortar infill walls are very labour intensive, primarily because they involve workers from many different trades.

Building methods using prefabricated wall panels and slabs and, sometimes, prefabricated columns are less labour intensive but the existing methods have considerable disadvantages.

In one existing method the wall panels are erected and held together using welded steel brackets. The panels are normally spaced about 20 mm apart and the gap is filled with grouting of non-shrink cement mortar, with or without a sealant on the external surface. Because of the narrow gap, it is difficult to complete the grouting properly. Because temperature changes cause expansion and contraction and wind force causes the building to move, the grouting may crack. Where sealants are used, these may deteriorate over a period of time. Both these effects will lead to ingress of water. Thus, in the long term maintainance costs are much higher than for a conventional reinforced concrete building with bricks and mortar infill walls.

In another method, columns, which may either be pre-cast or cast-in-situ, having panel-receiving grooves on their vertical surfaces are first erected. The wall panels are then lifted and fitted into the grooves and the joints grouted. This method has the disadvantage that the columns being cast first are rigid and in a fixed orientation so that any irregularity in alignment cannot easily be concealed and touch up work is laborious.

Thus, a new method for building using prefabricated wall panels that does not involve the use of grouting between the panels or between the panels and pre-erected columns would be particularly advantageous.

SUMMARY OF THE INVENTION

According to the invention, a building is erected using pre-cast wall panels, preferably load-bearing wall panels having a shear key on each vertical edge and starter bars on each horizontal edge, by first erecting the wall panels, and then casting a concrete column around the vertical edges of adjacent or intersecting wall panels using movable formwork made up from a set of standard modules that can be assembled to form different configurations of column for different panel arrangements.

The set of standard modules for assembling the formwork preferably comprises at least four different shaped modules, namely modules for forming straight sections, modules for forming curved sections of various radii and infill modules for forming a corner where two other modules coincide other than in a straight line.

The modules have means by which they can be connected together to form various shapes and sizes of column for joining two, three or four wall panels or for supporting a single wall panel at the end of a wall, such means on the straight and curved section modules preferably being flanges that can be held together by clips or other fastening means that extend rearwardly of the modules on their longitudinal edges. The infill modules preferably are hollow, generally square, tubes but preferably have one rounded corner.

The curved section modules preferably terminate in straight sections so that they can more readily be aligned with adjoining modules.

The moulding surfaces of the modules may, if desired, be shaped to impart decorative features to the cast columns. The pattern of any decorative features can be varied by using differently shaped modules.

The building method of the invention provides a number of advantages over the prior methods, for example, a) if space allows, the panels can be cast on site, which avoids the cost of delivery to the site, b) the surfaces of the wall panels can be cast with decorative features, if desired, c) the wall panels can be cast in any thickness to suit architectural and structural engineering requirements, d) the surface of the wall panels can be cast in fine concrete so that no plastering or other finishing of the walls is necessary, e) door, window and other openings can be incorporated into the wall panels in the casting process, f) the wall panels can be cast with either sleeping or standing formwork, g) the presence of shear keys and starter bars in the wall panels gives strong interlocking and high building strength after the columns have been cast, h) various sizes of wall panel can be used in the method, which allows the architect great freedom of design i) the alignment of the wall panels is easily controlled by seating the wall panels between removable timber markers.

j) any slight out-of-alignment of the wall panels can be easily concealed by the cast-in-situ columns.

k) the cast-in-situ columns prevent any ingress of water.

l) the decorative edge of cast-in-situ columns provides an interesting feature and design to the wall/column intersections.

DESCRIPTION OF PREFERRED EMBODIMENTS

Figure 2:
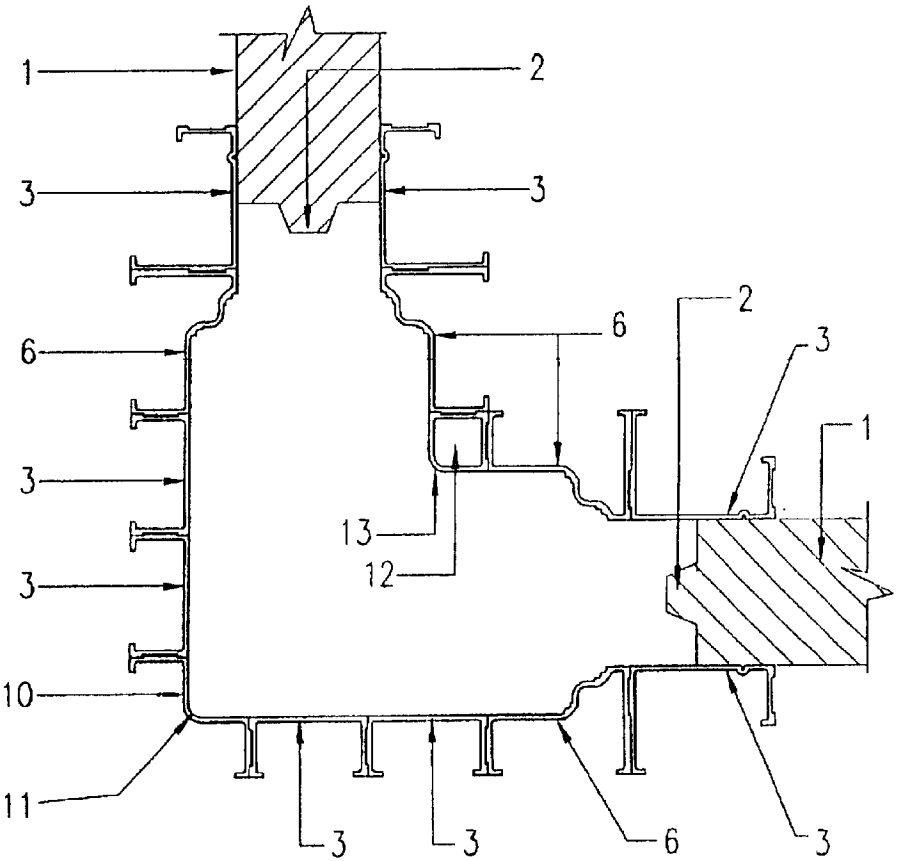
Figure 3:
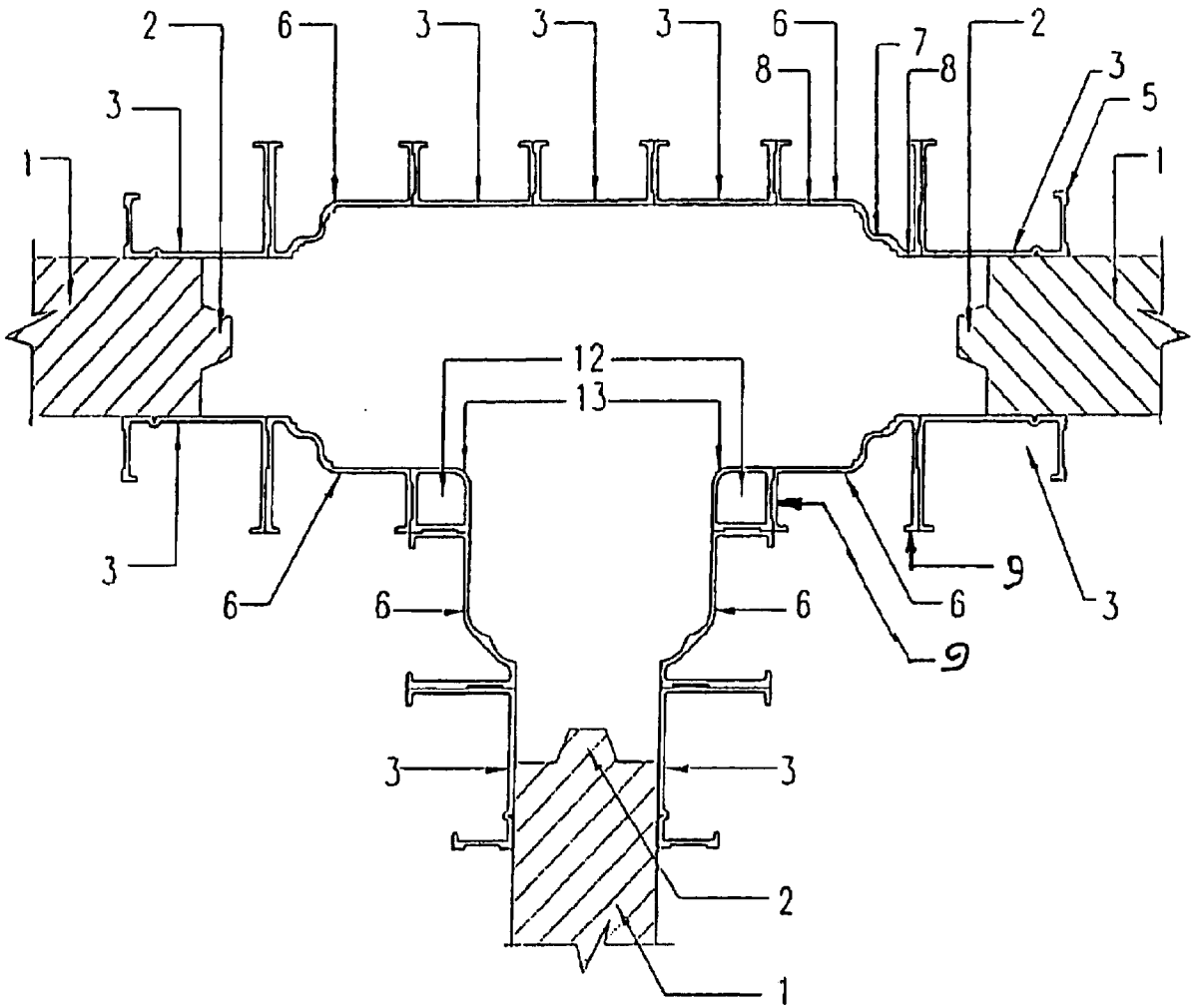
Figure 4:
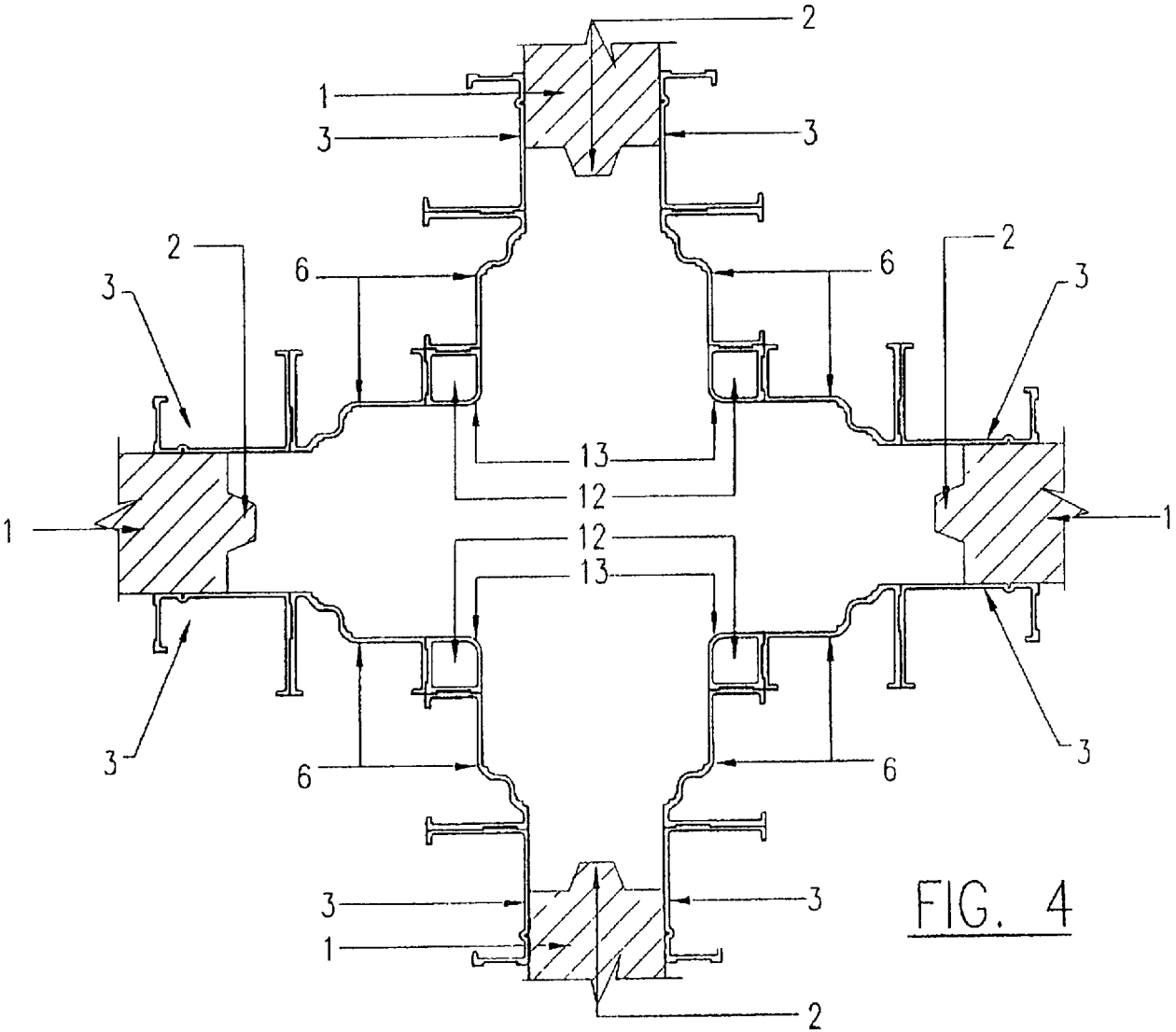
Figure 5:
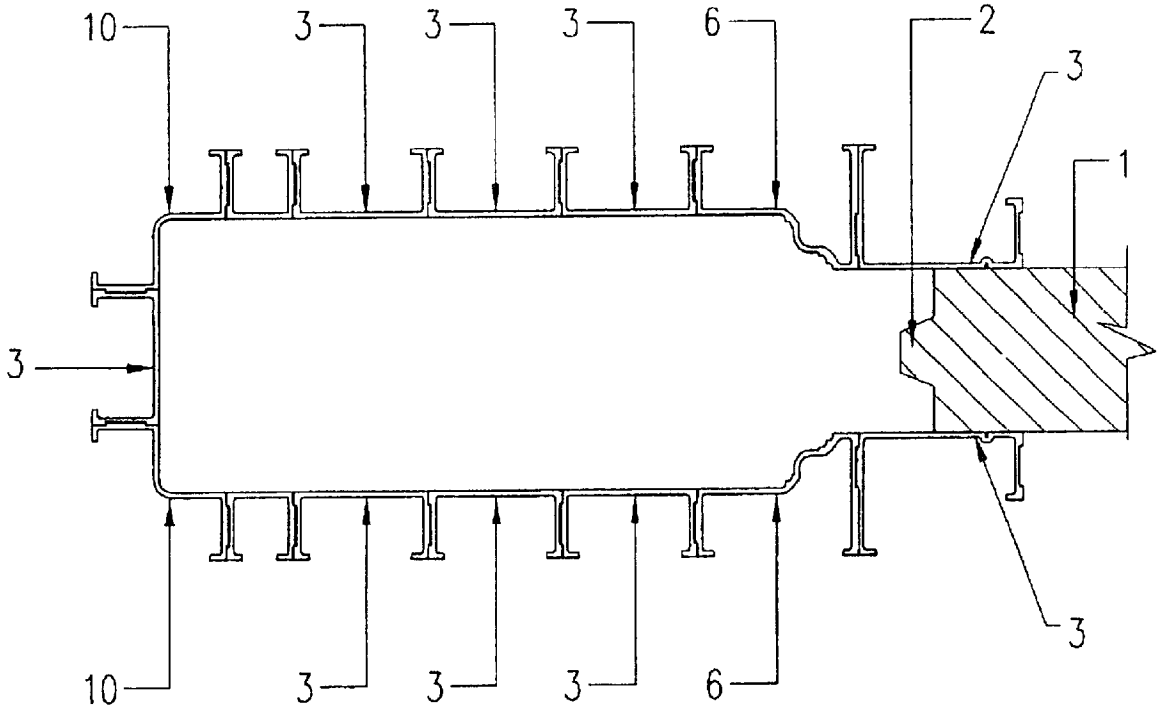

The invention will now be described in greater detail, by way of example, with reference to the drawings, in which FIG. 1 is a plan view showing the formwork for casting a column for joining two aligned wall panels, FIG. 2 is a plan view showing the formwork for casting a column for joining two wall panels at right angles, FIG. 3 is a plan view showing the formwork for casting a column for joining three wall panels, FIG. 4 is a plan view showing the formwork for casting a column for joining four wall panels, and FIG. 5 is a plan view showing the formwork for casting a column for a wall end cap.

As shown in the drawings, the wall panels 1 used in the method of the invention are cast with shear keys 2 on the edges that are vertical when the panels are erected. The wall panels also have cast in starter bars (not shown), where necessary.

The formwork for casting columns for supporting the wall panels 1 comprises four standard modules. The first module 3 for casting a straight column section comprises a flat face portion 4 and rearwardly extending flanges 5 by which adjacent modules can be connected. The second module 6 for forming a curved column section of large radius comprises a patterned portion 7 connecting two straight portions 8 arranged such that their planes intersect at right angles and each having a rearwardly extending flange 9 at its free edge. The third module 10 for forming a curved column edge section of smaller radius is similar to module 6 except that its curved portion 11 is of much tighter radius. The fourth module 12 is an infill module for forming a corner where two other modules meet at right angles and is of is of generally square section but with one corner 13 rounded in a curve of the same radius as curved portion 1 of module 10.

As shown in FIG. 1, for forming a column for joining two aligned wall panels 1, the formwork may comprise four modules 3 one on each side of each wall panel 1, four modules 6 each connected by one of its flanges 9 to one of the flanges 5 of each module 3, a number of further modules 3 depending on the desired length of the column connected by their flanges 5 to each other and to modules 6.

In the case where it is desired that the column on one or both sides of the column should be flush with the wall panels, modules 6 may be omitted, as appropriate.

As shown in FIG. 2, the formwork for forming a column between two wall panels meeting at right angles again may comprise four modules 3 one on each side of each wall panel 1, and four modules 6 each connected by one of its flanges 9 to one of the flanges 5 of each module 3. Because the flanges 9 on the free ends of modules 6 meet at right angles and cannot be connected together, an infill module 12 is used to fill the gap between the pairs of modules 6 and flanges 9 are connected to the walls of the infill modules 12. The external corner of the formwork is formed by a module 10.

As shown in FIG. 3, formwork for forming a column where three wall panels 3 meet, on the side remote from the third panel is the same as that for forming a column for two aligned wall panels 1 but on the other side is formed using modules 6 and infill modules 12 as described in relation to FIG. 2.

As shown in FIG. 4, formwork for forming a column where four wall panels meet is basically the same as that described in relation to FIG. 3 except that modules 6 and infill modules 12 are used on both sides of the formwork.

As shown in FIG. 5, to terminate a wall a column is formed using formwork that at the end enclosing the end of the wall panel 1 is as described in relation to FIG. 1 but at the other end utilises a pair of modules 10 separated by a module 3. The column may be made as long as desired by using as many modules 3 between modules 6 and 10.

Since the modules 3 adjacent the wall panels 1 overlap the edges of wall panels 1, any out of tolerance positioning of wall panels can be easily concealed.

What is claimed is:

1. A method of erecting a building using pre-cast wall panels, which comprises first erecting the wall panels and then casting a concrete column around the vertical edges of adjacent or intersecting wall panels using two or more movable formwork modules which together make up a set that can be assembled to form different configurations and sizes of column for different panel arrangements, each module having longitudinal edges and comprised of a central section and integral end sections that include a straight portion and a rearwardly extending flange located at the free end of each end section on the longitudinal edges, each flange extends perpendicularly to the straight portion so that adjacent modules can more readily be aligned and connected together;

said set of modules including a first module for forming straight sections, a second module for forming a curved column section of a larger radius that comprises a patterned portion in said central section; and a third module for forming curved sections having a smaller radius than the larger radius of the second module;

and a hollow infill module used for forming a corner where two other modules coincide at right angles, said infill module being of generally square cross-section, but with one corner rounded in a curve of the same radius as said smaller radius of said third module.

2. A method according to claim 1, wherein the wall panels are load-bearing wall panels having a shear key on each vertical edge.

3. A method according to claim 1, wherein each module has a moulding surface which is shaped to impart decorative features to the cast columns and/or column/wall intersections.

* * * * *